US009436146B2

(12) United States Patent
Ju et al.

(10) Patent No.: US 9,436,146 B2
(45) Date of Patent: Sep. 6, 2016

(54) REGULATION DEVICE, IMAGE FORMING APPARATUS USING THE SAME, AND A METHOD THEREOF

(71) Applicant: SAMSUNG ELECTRONICS CO., LTD., Suwon-si (KR)

(72) Inventors: Jeong Yong Ju, Suwon-si (KR); Byeong Hwa Anh, Seongnam-si (KR); Jun Ho Lee, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/225,986

(22) Filed: Mar. 26, 2014

(65) Prior Publication Data

US 2014/0294453 A1 Oct. 2, 2014

(30) Foreign Application Priority Data

Mar. 26, 2013 (KR) ..... 10-2013-0032128

(51) Int. Cl.

| | |
|---|---|
| ***G03G 15/01*** | (2006.01) |
| ***G03G 15/00*** | (2006.01) |
| ***G03G 15/16*** | (2006.01) |

(52) U.S. Cl.

CPC ..... *G03G 15/5054* (2013.01); *G03G 15/1615* (2013.01); *G03G 2215/00156* (2013.01)

(58) Field of Classification Search

CPC ..... G03G 15/5054; G03G 15/1615; G03G 15/14; G03G 2215/00156

USPC ..... 399/302

See application file for complete search history.

(56) References Cited

U.S. PATENT DOCUMENTS

2008/0124120 A1* 5/2008 Kang ..... 399/121
2012/0114397 A1* 5/2012 Hanatani ..... 399/302

* cited by examiner

*Primary Examiner* — Billy Lactaoen

(74) *Attorney, Agent, or Firm* — Staas & Halsey LLP

(57) ABSTRACT

An image forming apparatus is provided. The image forming apparatus, in a case in which a toner on a transfer belt is checked through a sensing unit, is capable of preventing a rotation of a guide roller, which is configured to guide the transfer belt, by use of a regulation device, so that a check error occurring due to vibration of the guide roller is reduced. Thus, the toner on the transfer belt is checked with increased accuracy and precision.

17 Claims, 6 Drawing Sheets

REGULATION DEVICE, IMAGE FORMING APPARATUS USING THE SAME, AND A METHOD THEREOF

CROSS-REFERENCE TO RELATED APPLICATIONS

This application is related to, and claims priority to, Korean Patent Application No. 10-2013-0032128, filed on Mar. 26, 2013 in the Korean Intellectual Property Office, the disclosure of which is incorporated herein by reference.

BACKGROUND

1. Field

Embodiments of the present disclosure relate to an image forming apparatus having a sensing unit configured to check a toner on a transfer belt.

2. Description of the Related Art

In general, an image forming apparatus is an apparatus designed to form an image on a printing medium. Types of image forming apparatus include a printer, a copy machine, a facsimile, and a multifunctional device having the functionalities of two or more of the printer, the copy machine, and the facsimile.

Such an image forming apparatus may include a body provided at one side thereof with an opening, and a side cover rotatably installed at the body to open and close the opening. The body may be provided at an inside thereof with a plurality of developing units to develop electrostatic latent images to visible images through toners according to colors, an exposure device to form an electrostatic latent image on a photoconductor of each of the developing units by irradiating light onto the photoconductor of the developing units, a transfer device to transfer the visible image developed on the photoconductor to the printing medium, and a fusing device to fix the toner to the printing medium.

The transfer device includes a transfer belt to receive a toner from the plurality of developing units to transfer the toner to the printing medium, a driving roller and a driven roller that may be disposed at an inner side of the transfer belt to rotate the transfer belt, and a guide roller to guide a portion of the transfer belt which moves toward the driving roller. A sensing unit may be disposed at a lower side of one portion of the transfer belt to check the toner on the transfer belt.

SUMMARY

Therefore, it is an aspect of the present disclosure to provide an image forming apparatus capable of checking a toner on a transfer belt through a sensor unit in a precise and an accurate manner.

Additional aspects of the disclosure will be set forth in part in the description which follows and, in part, will be obvious from the description, or may be learned by practice of the disclosure.

In accordance with an embodiment of the present disclosure, an image forming apparatus includes a developing unit, a transfer belt, a guide roller and a regulation device. The developing unit may be configured to develop an electrostatic latent image to a visible image through a toner. The transfer belt may be configured to transfer the visible image developed by the developing unit on a printing medium. The guide roller may be configured to guide the transfer belt by supporting one side of an inner surface of the transfer belt. The regulation device may be configured to regulate a rotation of the guide roller.

The image forming apparatus may include a sensing unit configured to check a tone transferred on the transfer belt. The regulation device may restrict the guide roller from rotating when the sensing unit checks the toner transferred on the transfer belt.

The guide roller may include a roller part and a first coupling part. The roller part may be configured to support the inner surface of the transfer belt. The first coupling part may be provided at one side of the roller part so as to be connected to the regulation device. The regulation device may include a regulation member installed so as to be movable in a first longitudinal direction. The regulation member may be provided at one side surface thereof with a second coupling part engaged with the first coupling part.

The regulation device may include an elastic member configured to elastically support the regulation member in a second longitudinal direction opposite to the first longitudinal direction.

The regulation device may include a driving motor, a worm being rotated by the driving motor, and a worm wheel teethed with the worm. The worm wheel may be provided at one side surface thereof with a first cam part having a crest and a trough alternately formed in a circumferential direction of the first cam part. The regulation member may be provided at other side surface thereof with a second cam part having a crest and a trough alternately formed in a circumferential direction of the second cam part so as to correspond to the first cam part.

The image forming apparatus may include a driving roller and a driven roller that may be disposed at opposite sides of inside of the transfer belt. The guide roller may guide a portion of the transfer belt that moves toward the driving roller. The sensing unit may check a portion of the transfer belt that moves toward the guide roller.

The image forming apparatus may include a transfer device frame to which the regulation member is movably installed. The guide roller may include a locking part configured to restrict a rotation of the guide roller by being locked with the transfer device frame. The transfer device frame may include a locking protrusion configured to be locked with the locking part.

The worm wheel may be provided at an other side surface thereof with a sensed part extending in a circumferential direction of the worm wheel. The regulation device may include a position detecting sensor to sense the sensed part.

The position detecting sensor may include a light emitting part and a light receiving part that may be disposed while being spaced apart from each other. The sensed part may pass through an area between the light emitting part and the light receiving part according to rotation of the worm wheel.

In accordance with an aspect of the present disclosure, an image forming apparatus includes a developing unit, a transfer belt, a guide roller and a regulation member. The developing unit may be configured to develop an electrostatic latent image to a visible image through a toner. The transfer belt may be configured to transfer the visible image developed by the developing unit on a printing medium. The guide roller may be configured to guide the transfer belt by supporting one side of an inner surface of the transfer belt. The regulation member may be movably installed and configured to restrict a rotation of the guide roller by being coupled to the guide roller depending on a position thereof while in motion.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
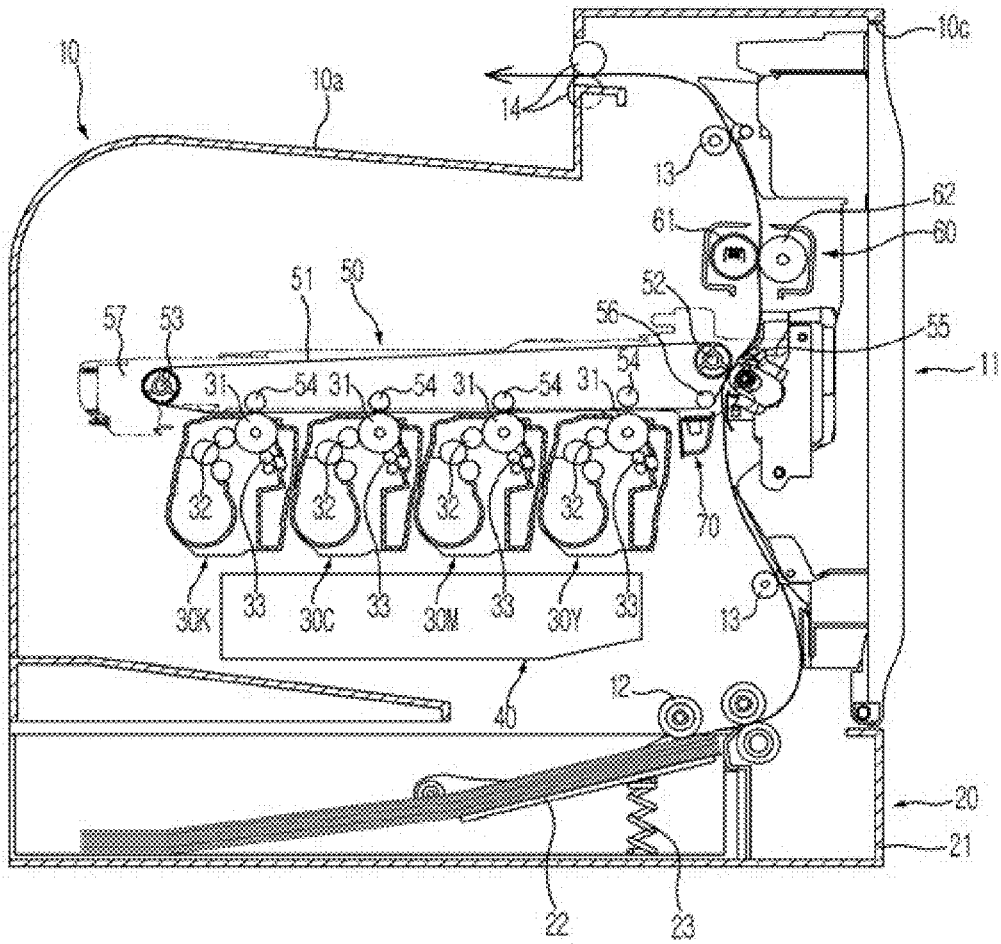
FIG. 1 illustrates an image forming apparatus in accordance with an embodiment of the present disclosure.

Reference will now be made in detail to the embodiments of the present disclosure, examples of which are illustrated in the accompanying drawings, wherein like reference numerals refer to like elements throughout.

As illustrated in FIG. 1, an image forming apparatus in accordance with an embodiment of the present disclosure includes a body 10 forming an external appearance of the image forming apparatus, a printing medium storage unit 20 to store printing medium, a plurality of developing units 30C, 30M, 30Y and 30K to develop electrostatic latent images to visible images according to colors by use of toner, an exposure unit 40 to form electrostatic latent images by irradiating light onto photoconductors 31 of the charged developing units 30C, 30M and 30Y and 30K, a transfer device 50 to transfer the visible image formed on the photoconductors 31 to the printing medium, which is being delivered from the printing medium storage unit 20, a fusing unit 60 to fix the toner, which is transferred to the printing medium, to the printing medium, and a sensing unit 70 to check the toner on a transfer belt 51 of the transfer device 50.

The body 10 may be provided at an upper portion thereof with a loading part 10*a* on which the printing medium completed with the image formation is loaded. A discharge port 10*b* may be provided at one side of the loading part 10*a* to allow the printing medium completed with the image formation to be discharged therethrough. An opening 10*c* may be provided at one side of the body 10 to allow repair of components or replacement of expendable materials inside the body 10. A side cover 11 may be included having a lower end rotatably installed at the body 10 so as to open and close the opening 10*c* while rotating on the lower end thereof.

The printing medium storage unit 20 includes a printing medium cassette 21 movably installed at the body 10, a knock-up plate 22 to load the printing media while being disposed in the printing medium cassette 21, and a knock up spring 23 to elastically support the knock-up plate 22.

Each of the developing units 30C, 30M, 30Y and 30K includes a photoconductor 31, on a charged surface of which an electrostatic latent image is formed by the exposure unit 40, a developing roller 32 to supply toner to the photoconductor 31, and a charging unit 33 to charge the surface of the photoconductor 31.

The developing units 30C, 30M, 30Y and 30K in accordance with an embodiment of the present disclosure include four developing units 30C, 30M, 30Y and 30K each storing one of toners of cyan C, magenta M, yellow Y and black K at an inside thereof, to develop one of cyan C, magenta M, yellow Y and black K colors. The four developing units 30C, 30M, 30Y and 30K may be disposed at a lower portion of the transfer device 50 side by side.

The exposure unit 40 forms the electrostatic latent images on the surfaces of the photoconductors 31 by irradiating light including image information to the photoconductors 31 provided at the developing units 30C, 30M, 30Y and 30K, respectively.

The transfer device 50 includes a transfer belt 51 on which visible images developed on the photoconductors 31 of the developing units 30C, 30M, 30Y and 30*k* are transferred in an overlapping manner, a driving roller 52 and a driven roller 53 disposed at opposite sides of inside the transfer belt 51 to rotate the transfer belt 51, a plurality of first transfer rollers 54 disposed opposite to the photoconductors 31 of the developing units 30C, 30M, 30Y and 30K, respectively, while interposing the transfer belt 51 therebetween, such that the visible images formed on the photoconductors 31 are transferred to the transfer belt 51, a guide roller 56 disposed on a path between the first transfer rollers 54 and the driving roller 52 and configured to guide a portion of the transfer belt 51 moving toward the driving roller 52 by supporting an inner surface of the transfer belt 51, and a transfer device frame 57 on which both ends of each of the first transfer rollers 54, the driving rollers 52 and the driven rollers 53 are rotatably installed.

A second transfer roller 55 may be disposed at the side cover opposite to the driving roller 52 while interposing the transfer belt 51 therebetween, to press the printing medium toward the transfer belt 51 to transfer the visible image of the transfer belt 51 to the printing media.

The fusing unit 60 includes a heating roller 61 to generate heat, and a pressing roller 62, an outer circumferential surface of which is formed of elastically deformable material to press the printing medium onto an outer circumferential surface of the heating roller 61.

At the body 10, a pick-up roller 12 may be disposed at an upper side of the printing medium storage unit 20 to pick up the printing media loaded on the knock-up plate 22 one by one, a delivery roller 13 to guide the printing medium, which is picked up by the pick-up roller 12, upward, and a discharge roller 14 disposed at an upper side of the fusing unit 60 while being adjacent to the discharge port 10*b* to allow the printing medium passing through the fusing unit 60 to be discharged through the discharge port 10*b*.

The body 10 may be provided at an inside thereof with frames configured to install and support various elements. The frames include a body frame 15, which may be disposed at a lower portion of an inner side of the opening 10*c* and on which the sensing unit 70 may be installed.

The sensing unit 70 may be disposed at a lower side of the transfer belt 51 and installed opposite to a lower surface of the transfer belt 51 to check the toner on the transfer belt 51. The sensing unit 70 in accordance with an embodiment of the present disclosure checks a portion of the transfer belt 51 passing through the first transfer rollers 54 and moving toward the guide roller 56.

The guide roller 56 includes a roller part 56*a* provided in a cylindrical shape to support the inner surface of the transfer belt 51, a first coupling part 56*b* provided at one side of the roller part 56*a* so as to be coupled to a second coupling part 84*a* of a regulation device 80, and a shaft part 56*c* connecting the roller part 56*a* to the first coupling part 56*b*. The guide roller 56 may be configured to rotate by receiving a force from the transfer belt 51 through the roller part 56*a*, which makes contact with the inner surface of the transfer belt 51, according to the movement of the transfer belt 51. In a rotation of the guide roller 56, the guide roller 56 is usually vibrated.

The sensing unit 70 may be configured to check a portion of the transfer belt 51 passing through the first transfer rollers 54 and moving toward the guide roller 56. In a case in which the guide roller 56 vibrates while rotating, a portion of the transfer belt 51 adjacent to the guide roller, that is, the portion of the transfer belt 51 to be sensed by the sensing unit 70 may be vibrated together with the guide roller 56, and may result in an inaccurate sensing by the sensing unit 70.

Figure 2:
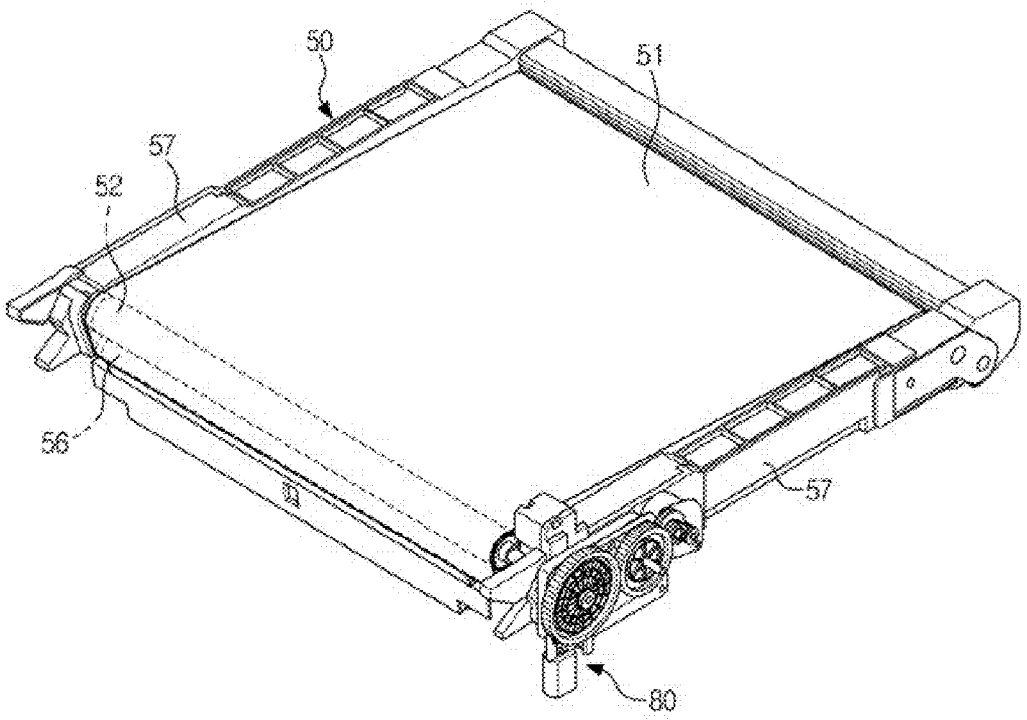
FIG. 2 illustrates a transfer device and a regulation device of an image forming apparatus in accordance with an embodiment of the present disclosure.
Figure 3:
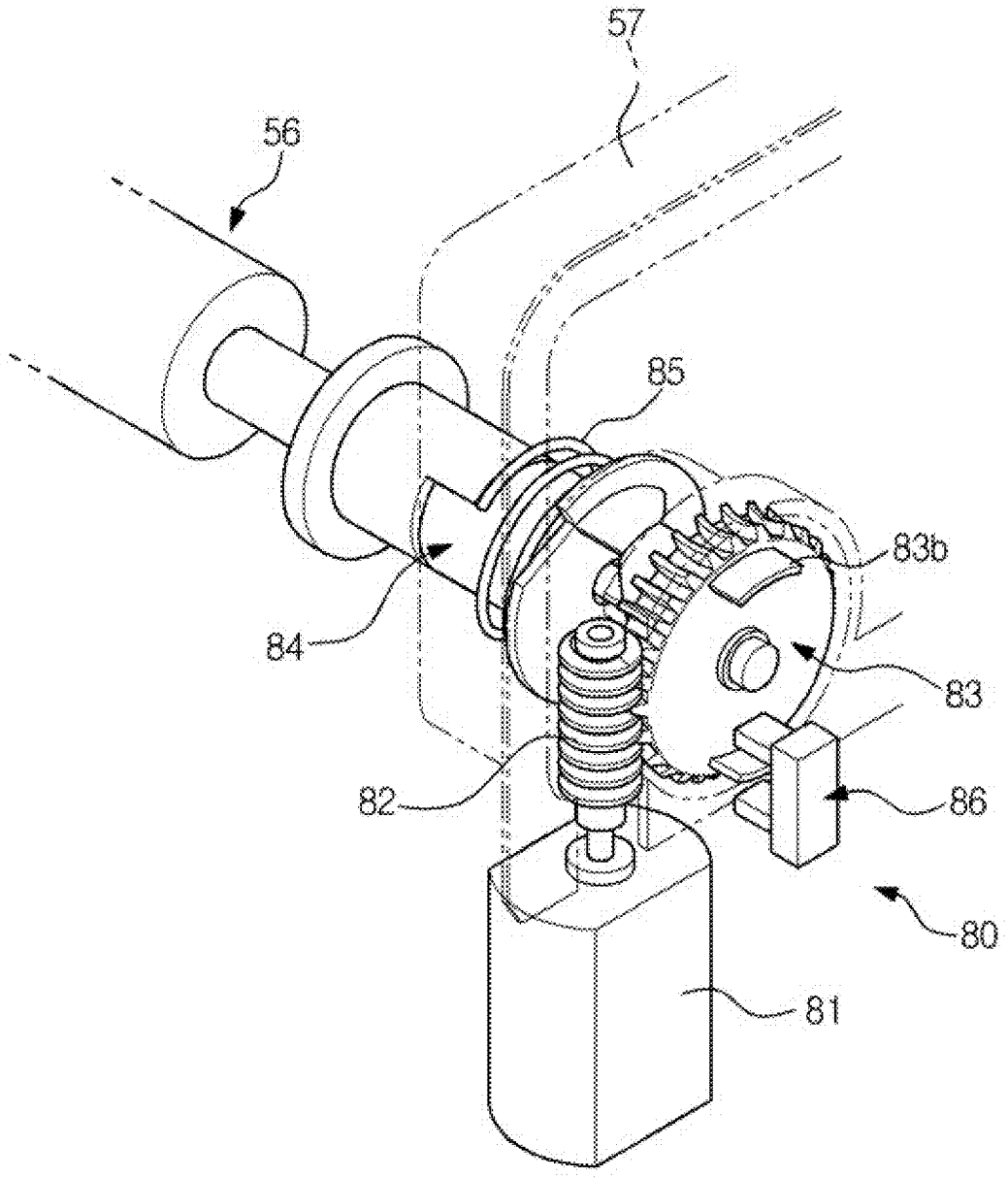
FIG. 3 illustrates a regulation device of an image forming apparatus in accordance with an embodiment of the present disclosure.

As illustrated in FIGS. 2 and 3, the image forming apparatus includes the regulation device 80 configured to restrict the rotation of the guide roller 56 while the toner on the transfer belt 51 is being checked by the sensing unit 70.

Figure 4:
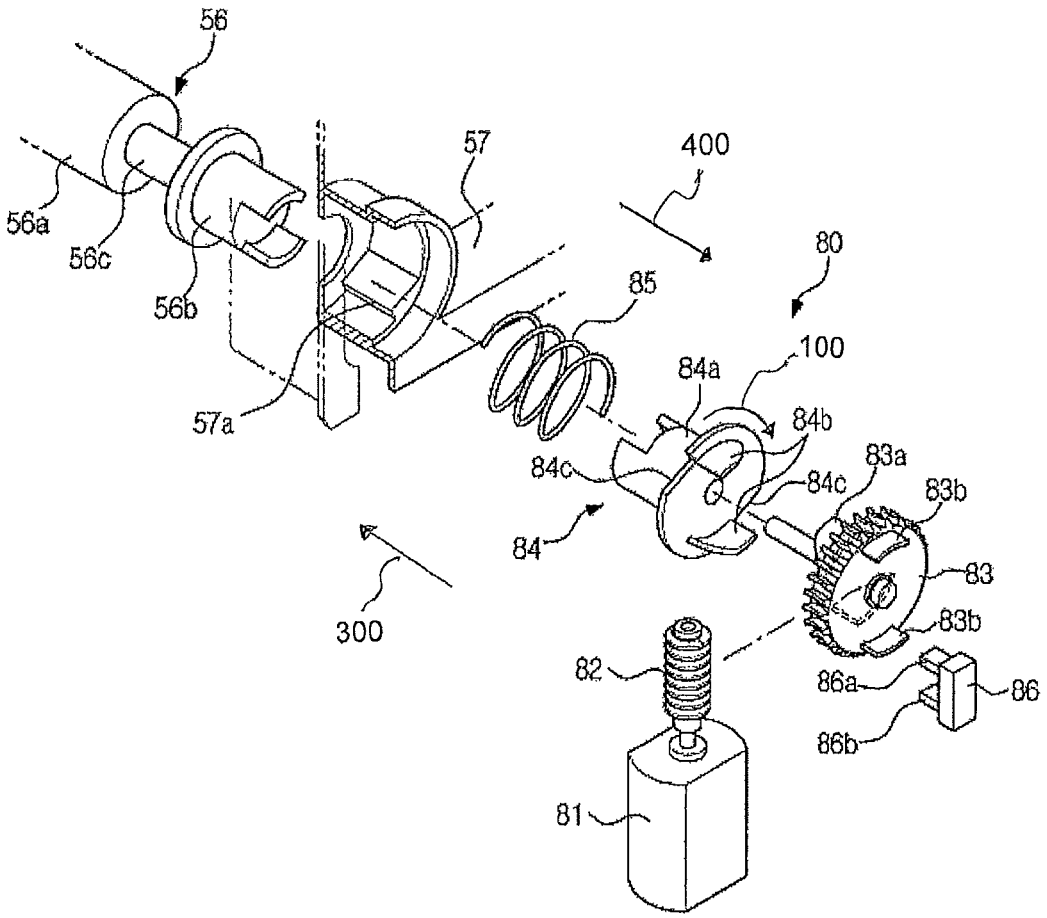
FIG. 4 is an exploded view illustrating a regulation device of an image forming apparatus in accordance with an embodiment of the present disclosure.

As illustrated in FIG. 4, the regulation device 80 includes a driving motor 81 to generate a rotating force, a worm 82 being rotated by the driving motor 81, and a worm wheel 83 being rotated according to the rotation of the worm 82 while being teethed with the worm 82. A regulation member 84 may be installed so as to rotate in a first circumferential direction 100 and configured to restrict the rotation of the guide roller 56 by being coupled to a first coupling part 56*b* while rotating in the first circumferential direction 100 according to a rotation of the worm wheel 83. An elastic member 85 may elastically support the regulation member 84 in a second longitudinal direction 400 opposite to a first longitudinal direction 300. Accordingly, the regulation member 84 may be coupled to the guide roller 56 by moving in the first longitudinal direction 300 so as to limit the rotation of the guide roller 56, and is separated from the guide roller 56 while moving in a second longitudinal direction 400 opposite to the first longitudinal direction 300 so as to allow the rotation of the guide roller 56.

The worm wheel 83 may be provided at one side surface thereof with a first cam part 83*a* having a crest and a trough alternately formed in a circumferential direction of the first cam part 83*a*. The worm wheel 83 may be provided at the other side surface thereof with a sensed part 83*b* that is provided in an arc shape and extends in a circumferential direction of the worm wheel 83. The regulation device 80 includes a position detecting sensor 86 including a light emitting part 86*a* and a light receiving part 86*b*. The sensed part 83*b* in accordance with an embodiment of the present disclosure includes one pair of sensed parts 83*b* being spaced apart from each other. The sensed parts 83*b* may be configured to pass through an area between the light emitting part 86*a* and the light receiving part 86*b*.

Accordingly, in a case in which the sensed part 83*b* is disposed at an area between the light emitting part 86*a* and the light receiving part 86*b* of the position detecting sensor 86, the sensed part 83*b* may be sensed by the position detecting sensor 86. In a case in which the sensed part 83*b* is not in the area between the light emitting part 86*a* and the light receiving part 86*b* of the position detecting sensor 86, the sensed part 83*b* is not sensed by the position detecting sensor 86. In this manner, a rotation position of the worm wheel 83 and a position of the first cam part 83*a* provided on the worm wheel 83 may be checked.

The regulation member 84 may be installed to pass through the transfer device frame 57 so as to be movable in the first longitudinal direction and the second longitudinal direction. The regulation member 84 may be provided at one side surface thereof with a second coupling part 84*a* engaged with the first coupling part 56*b* of the guide roller 56, and provided at the other side surface thereof with a second cam part 84*b* having a crest and a trough alternately formed in a circumferential direction of the second cam part 56*b* so as to correspond to the first cam part 83*a*. In accordance with an embodiment of the present disclosure, each of the first cam part 83*a* and the second cam part 84*b* may have two crests and two troughs in an alternating manner, so that the regulation member 84 moves in the first longitudinal direction according to the interaction between the first cam part 83*a* and the second cam part 84*b*.

The regulation member 84 includes a locking part 84*c* that is configured to restrict a rotation of the regulation member 84 by being locked with the transfer device frame 57, and the transfer device frame 57 includes a locking protrusion 57*a* that is provided at a position corresponding to the locking part 84*c* so as to be locked with the locking part 84*c*. Accordingly, the regulation member 84 is installed at the transfer device frame 57 so as to be movable in the first and second longitudinal directions while being prevented from rotating, so that the force transmitted to the second cam part 84*b* in a circumferential direction through the first cam part 83*a* is converted to have the first longitudinal direction as an active direction of force, which leads to the regulation member 84 moving in the first longitudinal direction.

The elastic member 85 has one end supported by the transfer device frame 57, and the other end supported by the locking part 84*c* of the regulation member 84, thereby elastically supporting the regulation member 84 in the second longitudinal direction.

An exemplary operation of an image forming apparatus in accordance with the present disclosure is described with reference to the accompanied drawings in detail.

Figure 5:
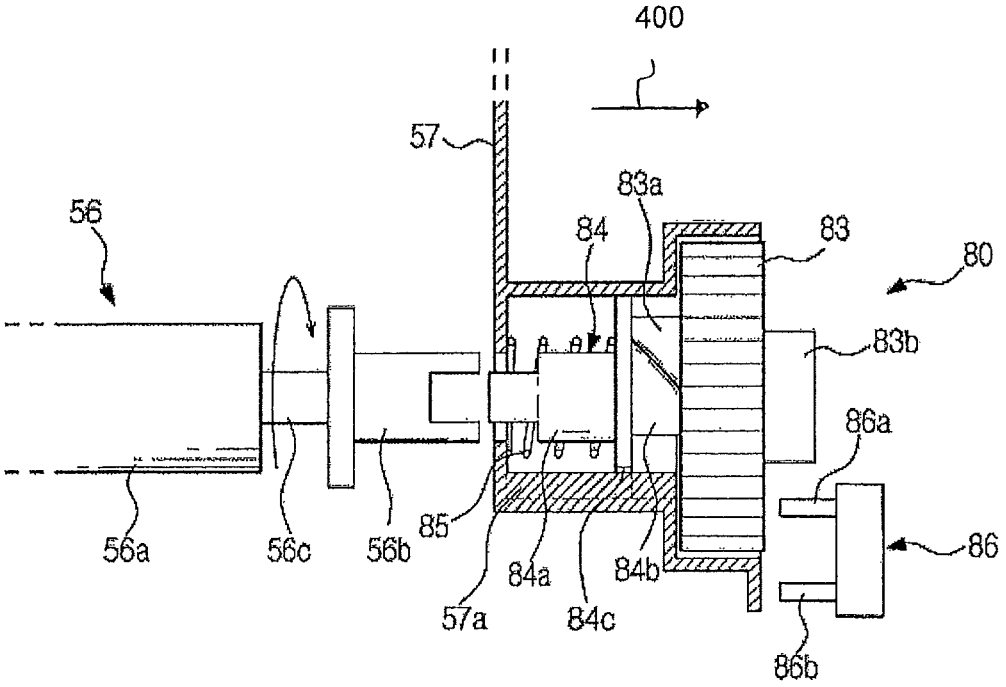
FIG. 5 illustrates an exemplary state before a guide roller is regulated by a regulation device of an image forming apparatus in accordance with an embodiment of the present disclosure.

In a state that the toner on the transfer belt 51 is not checked through the sensing unit 70, as illustrated in FIG. 5, the crest of the first cam part 83*a* may be inserted into the trough of the second cam part 84*b*, and the crest of the second cam part 84*b* may be inserted into the trough of the first cam part 83*a*. Thus, the regulation member 84 is kept in a state moved in the second longitudinal direction 400, by an elastic restoring force of the elastic member 85.

Accordingly, the second coupling part 84*a* is kept in a state of being spaced apart from the first coupling part 56*b*, and the guide roller 56 guides the transfer belt 51 while rotating according to the movement of the transfer belt 51.

Figure 6:
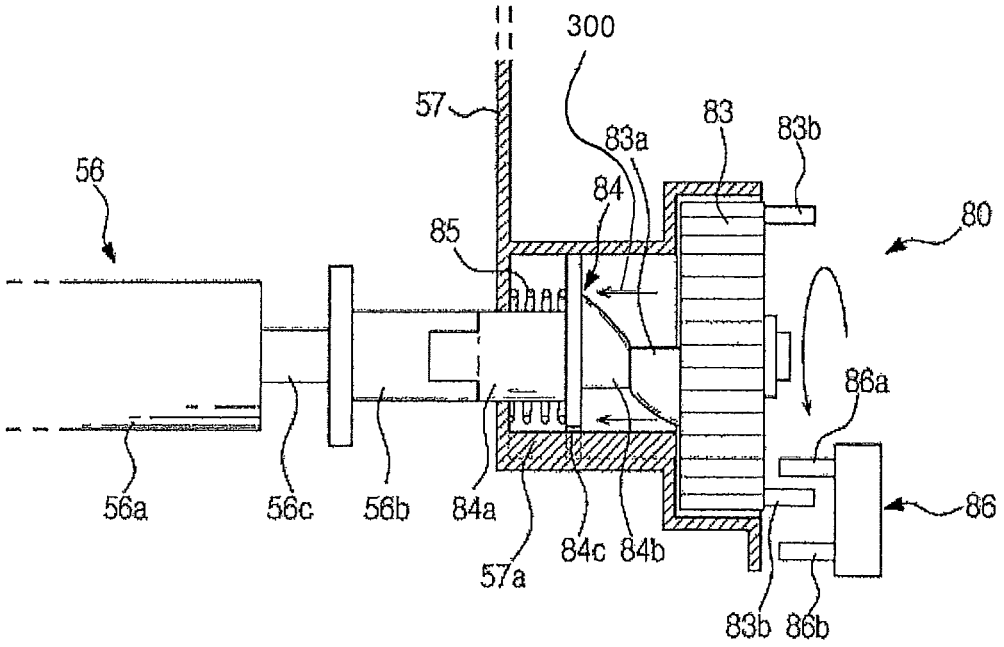
FIG. 6 illustrates an exemplary state of a guide roller regulated by a regulation device of an image forming apparatus in accordance with an embodiment of the present disclosure.

In a state that the toner on the transfer belt 51 is checked through the sensing unit 70, as illustrated in FIG. 6, the worm 82 and the worm wheel 83 are rotated by the driving motor 81, and the first cam part 83*a* provided at the worm wheel 83 transmits force to the regulation member 84 through the second cam part 84*b* according to the rotation of the worm wheel 83, and thus the regulation member 84 is moved in the first longitudinal direction 300.

In this case, the worm wheel 83 may be rotated at a predetermined angle at which the crest of the first cam part 83*a* makes contact with the crest of the second cam part 84*b*. The rotation of the predetermined angle may be determined by the sensed part 83*b* and the position detecting sensor 86.

As the worm wheel 83 rotates at the predetermined angle, the regulation member 84 moves in the first longitudinal direction, and accordingly, the second coupling part 84*a* provided at the regulation member 84 is coupled to the first coupling part 56*b* of the guide roller 56. The locking part 84*c* and the locking protrusion 57*a* prevent the regulation member 84 from rotating, and therefore, in the state of the first coupling part 56*b* coupled to the second coupling part 84*b*, the guide roller 56 is also prevented from rotating and stops rotating.

Accordingly, in a state that the sensing unit 70 checks the toner on the transfer belt 51, the guide roller 56 does not rotate, so that vibration occurring during a rotation of the guide roller 56 is not generated, thereby precisely and accurately checking the toner on the transfer belt 51 through the sensing unit 70.

When a toner on the transfer belt is checked through the sensing unit, the guide roller is restricted from rotating by way of a regulation device, so that vibration occurring during a rotation of the guide roller is prevented from exerting influence on checking the toner on the transfer belt, and thus the toner on the transfer belt is precisely and accurately checked.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a transfer belt configured to transfer a visible image developed by a developing unit on a printing medium;

a guide roller configured to guide the transfer belt by supporting one side of an inner surface of the transfer belt; and a regulation device configured to regulate a rotation of the guide roller, wherein at least a part of the regulation device being movable to regulate the rotation of the guide roller, and wherein at least a part of a regulation member is coupled to the guide roller by moving in a first longitudinal direction, and is separated from the guide roller by moving in a second longitudinal direction opposite to the first longitudinal direction.

2. An image forming apparatus comprising:

a transfer belt configured to transfer a visible image developed by a developing unit on a printing medium;

a guide roller configured to guide the transfer belt by supporting one side of an inner surface of the transfer belt;

a regulation device configured to regulate a rotation of the guide roller; and a sensing unit configured to check a toner transferred on the transfer belt, wherein at least a part of the regulation device being movable to regulate the rotation of the guide roller, and wherein the regulation device restricts the guide roller from rotating when the sensing unit checks the toner transferred on the transfer belt.

3. The image forming apparatus of claim 1, wherein the guide roller comprises:

a roller part configured to support the inner surface of the transfer belt; and a first coupling part provided at one side of the roller part so as to be connected to the regulation device, wherein the regulation device comprises the regulation member installed so as to be movable in the first longitudinal direction parallel to the axis of the guide roller, and the regulation member is provided at one side surface thereof with a second coupling part engageable with the first coupling part.

4. The image forming apparatus of claim 2, wherein the regulation device comprises an elastic member configured to elastically support the regulation member in a second longitudinal direction opposite to the first longitudinal direction.

5. The image forming apparatus of claim 2, wherein:

the regulation device comprises a driving motor, a worm being rotated by the driving motor, and a worm wheel teethed with the worm;

the worm wheel is provided at one side surface thereof with a first cam part having a crest and a trough alternately formed in a circumferential direction of the first cam part; and the regulation member is provided at an other side surface thereof with a second cam part having a crest and a trough alternately formed in a circumferential direction of the second cam part so as to correspond to the first cam part.

6. The image forming apparatus of claim 2, further comprising:

a driving roller and a driven roller that are disposed at opposite sides of inside of the transfer belt, wherein the guide roller guides a portion of the transfer belt which moves toward the driving roller, and the sensing unit checks a portion of the transfer belt that moves toward the guide roller.

7. The image forming apparatus of claim 3, further comprising a transfer device frame to which the regulation member is movably installed, wherein the guide roller comprises a locking part configured to restrict a rotation of the guide roller by being locked with the transfer device frame, and the transfer device frame comprises a locking protrusion configured to be locked with the locking part.

8. The image forming apparatus of claim 5, wherein:

the worm wheel is provided at an other side surface thereof with a sensed part extending in a circumferential direction of the worm wheel; and the regulation device comprises a position detecting sensor to sense the sensed part.

9. The image forming apparatus of claim 8, wherein:

the position detecting sensor comprises a light emitting part and a light receiving part that are disposed while being spaced apart from each other; and the sensed part passes through an area between the light emitting part and the light receiving part according to rotation of the worm wheel.

10. An image forming apparatus comprising:

a transfer belt configured to transfer a visible image developed by a developing unit on a printing medium;

a guide roller configured to guide the transfer belt by supporting one side of an inner surface of the transfer belt; and a regulation member movably installed and configured to restrict a rotation of the guide roller by being coupled to the guide roller depending on a position thereof while in motion, wherein at least a part of the regulation member is coupled to the guide roller by moving in a first longitudinal direction, and is separated from the guide roller by moving in a second longitudinal direction opposite to the first longitudinal direction.

11. The image forming apparatus of claim 10, further comprising:

a driving motor configured to generate a rotating force;

a worm rotating by the driving motor; and a worm wheel teethed with the worm, wherein the worm wheel is provided at one side surface thereof with a first cam part having a crest and a trough alternately formed in a circumferential direction of the first cam part;

the regulation member is provided at an other side surface thereof with a second cam part having a crest and a trough alternately formed in a circumferential direction of the second cam part so as to correspond to the first cam part; and the at least the part of the regulation member movably installed moves in the first longitudinal direction parallel to the axis of the guide roller according to an interaction between the first cam part and the second cam part.

12. The image forming apparatus of claim 11, further comprising an elastic member configured to elastically support the at least the part of the regulation member in a second longitudinal direction opposite to the first longitudinal direction.

13. The image forming apparatus of claim 11, wherein the worm wheel is provided at an other side surface thereof with a sensed part extending in a circumferential direction of the worm wheel; and the image forming apparatus further comprises a position detecting sensor to sense the sensed part.

14. The image forming apparatus of claim 11, wherein the guide roller comprises:

a roller part configured to support the inner surface of the transfer belt; and a first coupling part provided at one side of the roller part so as to be connected to the regulation member, and wherein the regulation member is provided at one side surface thereof with a second coupling part engaged with the first coupling part.

15. An image forming apparatus comprising a transfer belt configured to transfer a visible image developed by a developing unit on a printing medium;

a guide roller configured to guide the transfer belt by supporting one side of an inner surface of the transfer belt;

a regulation member, at least a part of the regulation member movably installed and configured to restrict a rotation of the guide roller by being coupled to the guide roller depending on a position thereof while in motion; and a sensing unit configured to check the toner transferred on the transfer belt.

16. A regulation member for an image forming apparatus including a guide roller, the regulation member, comprising:

a coupling part configured to restrict a rotation of the guide roller by being coupled to the guide roller depending on a position thereof while in motion, wherein at least a part of the regulation member is movably installed in the image forming apparatus so as to move in a first longitudinal direction to be coupled with the guide roller, and to move in a second longitudinal direction opposite to the first direction to separate from the guide roller.

17. A method for improving accuracy of a checking of a toner on a transfer belt in an image forming apparatus, the method comprising:

moving a coupling part to couple with a roller guiding the transfer belt;

coupling the coupling part and the roller during the checking to restrict a vibration of the roller.

* * * * *